US006109451A

United States Patent [19]

Grimes

[11] Patent Number: 6,109,451

[45] Date of Patent: Aug. 29, 2000

[54] THROUGH-FLOW HYDROCYCLONE AND THREE-WAY CLEANER

[76] Inventor: David B. Grimes, 93 Washington St., Greenfield, Mass. 01301-3411

[21] Appl. No.: 09/191,730

[22] Filed: Nov. 13, 1998

[51] Int. Cl.[7] ..... B03B 5/28

[52] U.S. Cl. ..... 209/725; 209/731; 209/733; 210/512.1

[58] Field of Search ..... 209/208, 210, 209/725, 724, 727, 731, 733, 211; 210/512.1, 512.2, 512.3

[56] References Cited

U.S. PATENT DOCUMENTS

| | | | |
|---|---|---|---|
| 2,102,525 | 12/1937 | Freeman . | |
| 2,769,546 | 11/1956 | Fontein . | |
| 2,787,374 | 4/1957 | Krebs . | |
| 2,809,567 | 10/1957 | Woodruff . | |
| 3,130,157 | 4/1964 | Kelsall et al. | 210/512 |
| 3,405,803 | 10/1968 | Bahr et al. . | |
| 3,696,934 | 10/1972 | Oisi | 210/512 |
| 4,259,180 | 3/1981 | Surakka et al. . | |
| 4,309,283 | 1/1982 | Vikiö et al. . | |
| 4,378,289 | 3/1983 | Hunter . | |
| 4,414,112 | 11/1983 | Simpson et al. . | |
| 4,473,478 | 9/1984 | Chivrall | 210/788 |
| 4,578,199 | 3/1986 | Peel et al. . | |
| 4,786,412 | 11/1988 | Lister et al. . | |
| 4,793,925 | 12/1988 | Duvall et al. | 210/512.1 |
| 4,797,203 | 1/1989 | Macierewicz . | |
| 4,834,887 | 5/1989 | Broughton . | |
| 4,842,145 | 6/1989 | Boadway . | |
| 4,919,796 | 4/1990 | Vikiö . | |
| 5,024,755 | 6/1991 | Livsey . | |
| 5,240,115 | 8/1993 | Crossley et al. . | |
| 5,266,198 | 11/1993 | Vikiö . | |
| 5,470,465 | 11/1995 | Moorehead et al. . | |
| 5,566,835 | 10/1996 | Grimes . | |
| 5,769,243 | 6/1998 | McCarthy . | |
| 5,934,484 | 8/1999 | Grimes | 209/725 |

FOREIGN PATENT DOCUMENTS

| | | |
|---|---|---|
| 058484 | 2/1981 | European Pat. Off. . |
| 105037A | 4/1984 | European Pat. Off. . |
| 3 329 256 | 2/1984 | Germany . |
| 2177950 | 2/1987 | United Kingdom . |
| WO 9847622 | 10/1998 | WIPO . |

OTHER PUBLICATIONS

"Uniflow Cleaners," by Beloit Corporation, 4 pages Form No. SB–79–004R 7114.

"Beloit Jones Posiflow™ Cleaners," by Beloit Corporation, 2 pages, Form No. SB–79–005.

Patent Application No. 08/844,040 for "Channeling Dam for Centrifugal Cleaner," Beloit Corporation, Apr. 18, 1997 Patent #5934484.

*Primary Examiner*—Donald P. Walsh
*Assistant Examiner*—David A. Jones

[57] ABSTRACT

The conventional infeed head and inverted cone of a Uniflow cleaner are connected by a generally cylindrical channel dam segment which has an annular inwardly extending channel dam. The narrow end of the inverted cone is connected to a separation body through which a vortex finder extends into the inverted cone. The light reject particles are removed from the input flow through the vortex finder. Accepts and heavy rejects flow into an inverted hydrocyclone chamber within the separation body defined between an outer cylindrical ring and an inner cylindrical ring and the vortex finder. An annular heavy rejects chamber is defined exterior to the outer ring, and fluid is drawn off tangentially therefrom. Accepts flow downwardly though the inner ring into a bowl beneath the separation body, where they are removed from an accepts outlet. The cylindrical or concave surfaces of the separation body are economical to manufacture.

17 Claims, 3 Drawing Sheets

THROUGH-FLOW HYDROCYCLONE AND THREE-WAY CLEANER

BACKGROUND OF THE INVENTION

The present invention relates to particle separators in general, and to hydrocyclone cleaners for papermaking pulp stock in particular.

Paper is manufactured from cellulose fibers which may be extracted from wood or may be recovered recycled paper. The various sources and processes for creating and separating the individual wood fibers results in a paper stock containing contaminants which must be removed before the wood fibers can be used to make paper. While many contaminants can be moved from the fiber stock by washing, other contaminants are of a size or physical makeup which makes their removal by filtration difficult. Historically, hydrocyclones or centrifugal cleaners of relatively small size, normally from 2–72 inches in diameter, have been employed. It has been found that the centrifugal type cleaner is particularly effective at removing small size contaminants such as broken fibers, spherical particles, and seeds, as well as non-woody fine dirt such as bark, sand, grinderstone grit and metal particles.

The relatively small size of the centrifugal cleaners allows the employment of certain hydrodynamic and fluid dynamic forces provided by the combination of centrifugal forces and liquid shear planes produced within the hydrocyclone which allows the effective separation of small contaminants and debris.

The advent of certain modern sources of pulp fibers such as tropical wood species and recycled paper which is contaminated with stickies, waxes, hot melt glues, polystyrenes, polyethylenes, and other low density materials including plastics and shives presents additional problems in the area of stock preparation. The ability of the hydrocyclone to separate both high density and low density contaminants gives them particular advantages in dealing with the problem of cleaning modern sources of paper fiber. Many modern fiber sources tend to be contaminated with both heavyweight and lightweight contaminants.

In my earlier U.S. Pat. No. 5,566,835 which is incorporated herein by reference, I described a hydrocyclone which can separate pulp stock into a heavyweight reject stream, a lightweight reject stream, and an accepts stream containing the useful wood fibers. Such a three-way cleaner provides an excellent means for treating pulp flows through the use of a molded lower chamber having inverted frustoconical and toroidal segments. Although providing effective three-way separation, such a cleaner requires complicated geometries which can be expensive to manufacture.

In addition, in my U.S. Pat. No. 5,934,484, filed Apr. 18, 1997, the disclosure of which is incorporated by reference herein, I disclosed a cleaner having an inwardly extending circumferential channeling dam ahead of the inverted conical chamber of the cleaner. The channeling dam or ring improves the operation of the cleaner by eliminating a tendency of the infed stock to spiral down the inside walls of the inverted conical chamber.

While existing hydrocyclones have been developed to remove both heavy and light contaminants, further improvements in this area are highly desirable. The hydrocyclone as it is used to clean pulp is a small device, and is used in banks of up to sixty or more cleaners. Thus each hydrocyclone must be of extremely high reliability and require minimal maintenance or the entire hydrocyclone system will have poor reliability and high maintenance costs. Of particular relevance is the efficiency with which the hydrocyclone performs the separation function. Efficiency determines the number of stages which must be used to achieve a given level of separation. More separation stages means higher energy consumption and higher equipment costs. Because of the great number of cleaner units employed in each pulp treatment installation, cost reductions in the manufacture of an individual unit will be multiplied many times in a single papermaking facility.

What is needed is a three-way through flow cleaner which resists channeling and which is economical to manufacture.

SUMMARY OF THE INVENTION

The through flow cleaner of this invention is assembled from modular components of simplified geometry to achieve an effective three-way separation at reduced manufacturing cost. The conventional infeed head and inverted cone of a Uniflow cleaner are connected by a generally cylindrical channel dam segment which has an annular inwardly extending channel dam. The narrow end of the inverted cone is connected to a separation body through which a vortex finder extends into the inverted cone. The light reject particles are removed from the input flow through the vortex finder. Accepts and heavy rejects flow into an inverted hydrocyclone chamber within the separation body defined between an outer cylindrical ring and an inner cylindrical ring and the vortex finder. An annular heavy rejects chamber is defined exterior to the outer ring, and fluid is drawn off tangentially from the heavy rejects chamber. Accepts flow downwardly though the inner ring into a bowl beneath the separation body, where they are removed from an accepts outlet. The cylindrical or concave surfaces of the separation body are economical to manufacture, and the resulting cleaner is readily exchanged for installed conventional cleaners.

It is a feature of the present invention to provide an economical through flow cleaner which can separate light and heavy rejects from accept fibers.

It is another feature of the present invention to provide a through flow cleaner which can be constructed using certain elements of existing cleaners to thereby enable three-way separation.

It is also a feature of the present invention to provide a through flow cleaner with three way separation with a separation chamber which can be constructed of primarily cylindrical shapes.

Further objects, features and advantages of the invention will be apparent from the following detailed description when taken in conjunction with the accompanying drawings.

DESCRIPTION OF THE PREFERRED EMBODIMENTS

Figure 1:
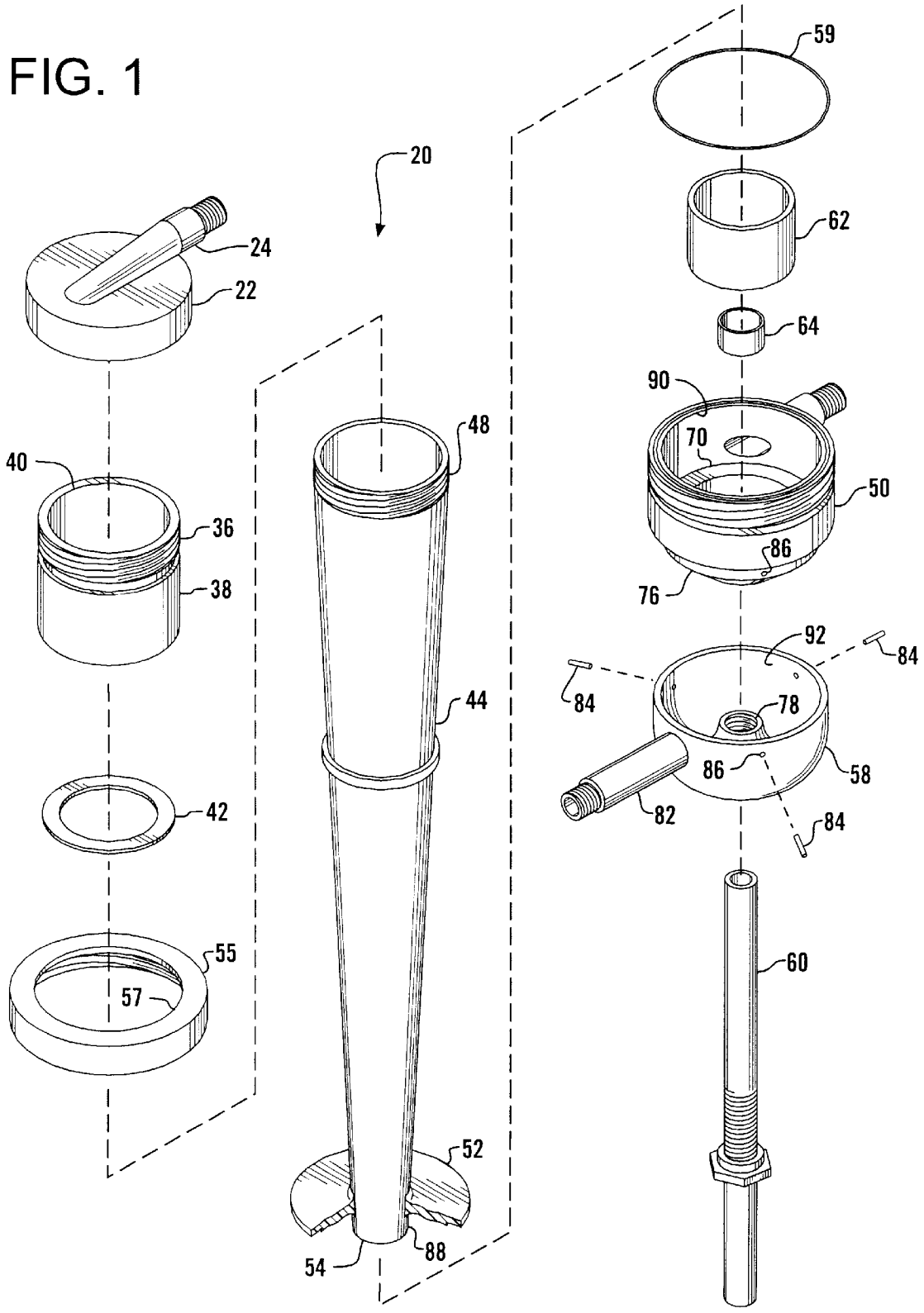
FIG. 1 is an exploded isometric view of the through-flow cleaner of this invention.
Figure 2:
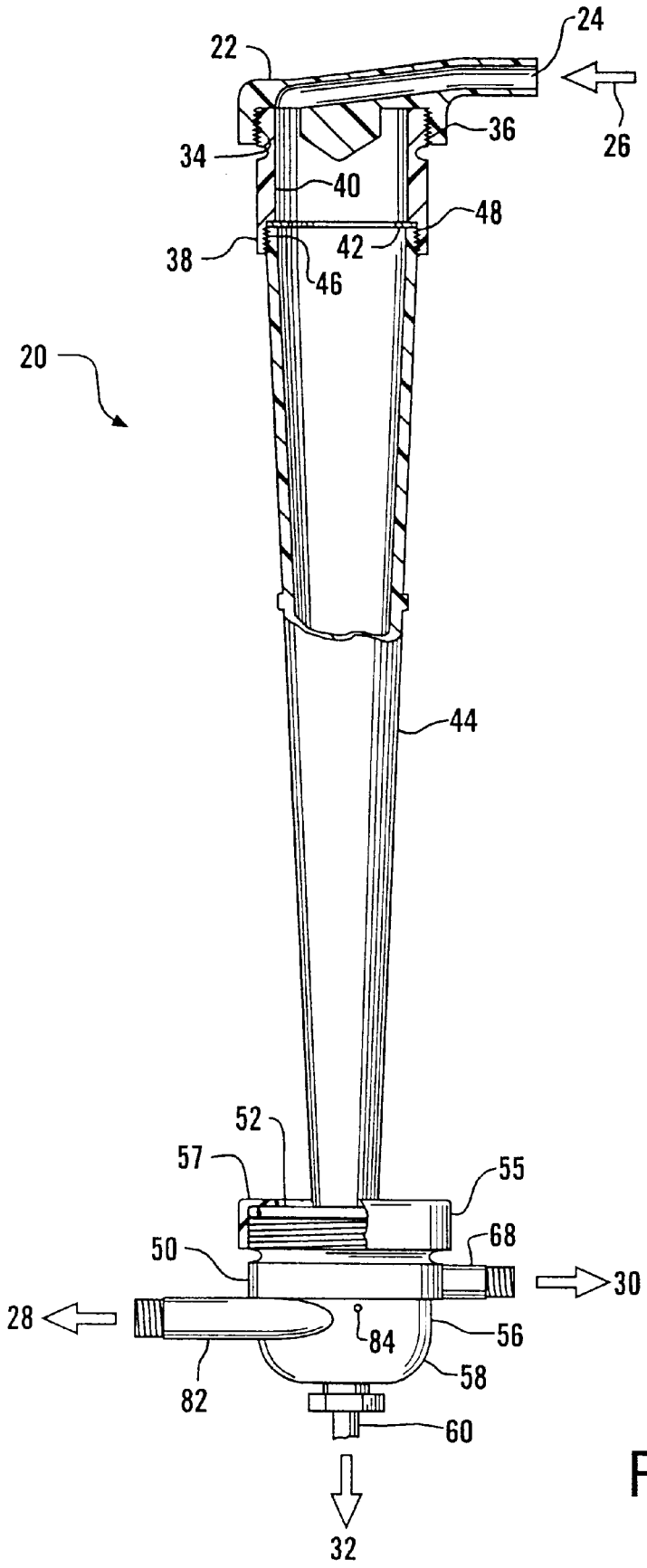
FIG. 2 is a side elevational view, partially broken away in cross-section, of the cleaner of FIG. 1.
Figure 3:
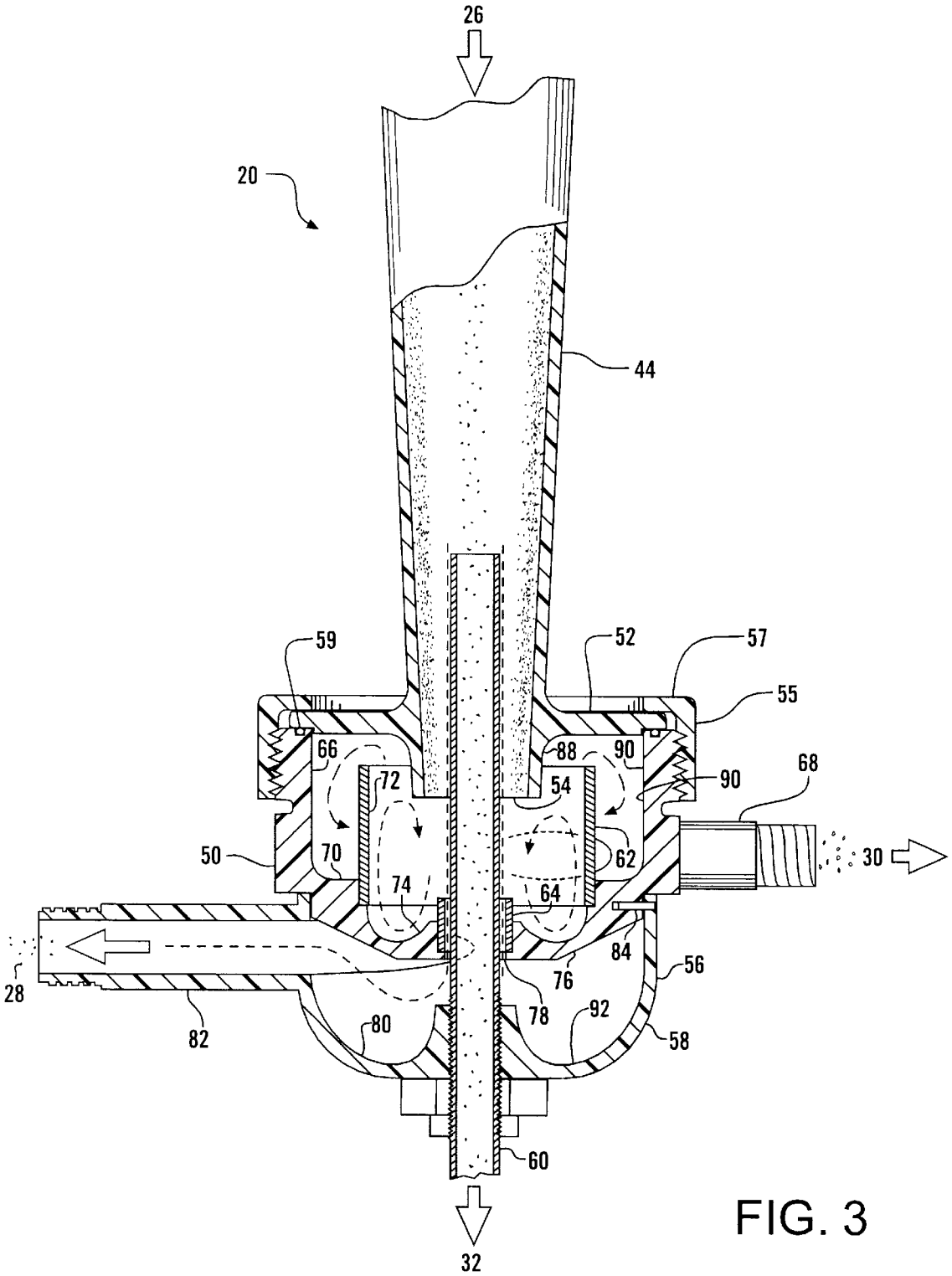
FIG. 3 is an enlarged fragmentary cross-sectional view of the cleaner of FIG. 2, with the fluid flows shown schematically.

Referring more particularly to FIGS. 1–3, wherein like numbers refer to similar parts, the through flow cleaner 20 has a fluid inlet head 22 which may be similar to the head used in the Uniflow cleaner manufactured by Beloit Corp. of Beloit, Wis. In a preferred embodiment, the cleaner 20 may be assembled using some common parts with the conventional Uniflow cleaner. The inlet head 22 has an inlet 24 through which stock enters the cleaner 20. The input stock 26 will generally contain an assortment of fiber and non-fiber particulate matter within a fluid. The cleaner 20 will separate the desirable fiber or accepts 28, from the heavy rejects 30 and the light rejects 32.

The inlet head has internal threads 34 at its lower end, which engage with external threads 36 on the upper end of a cylindrical channel dam segment 38. The channel dam segment 38 defines a cylindrical internal chamber 40 with a lower channel dam 42. The channel dam 42 may be formed by a metal ring, similar in shape to a washer, which is press fit to the channel dam segment 38 and is thus positioned between the channel dam segment 38 and an inverted cone 44. The channel dam segment has internal threads 46 at its lower end which engage with external threads 48 on the inverted cone 44. The cylindrical channel dam chamber 40 provides a volume for residence time of the input pulp. The channel dam 40 is preferably press fit to the channel dam segment. In a channel dam segment 38 with an interior diameter of 3.83 inches, the ring of the channel dam 40 may have an internal diameter of 3.0 inches and a thickness of about ¼ inch. The distance from the inlet to the channel dam segment and to the top of the channel dam may be approximately 2.7 inches. As the input stock 26 is injected tangentially through the inlet 24, the channel dam 40 prevents the stock from developing a flow spiral which propagates down the conical walls of the inverted cone 44.

The flow leaves the channel dam chamber 40 and travels into the inverted cone 44 where the components of the pulp slurry separate due to fluid drag and specific gravity and other various characteristics used by hydrocyclone cleaners. The cone is preferably plastic, and may be formed of injection molded polypropylene, glass filled. The flow reaches the bottom of the inverted cone 44 and discharges into a separation body 50 where the separated flows are isolated from each other by splitting the flows. The inverted cone 44 may be a conventional Uniflow cleaner inverted cone.

The separation body 50 is connected to a flange 52 which extends radially outwardly from the inverted cone 44 at a position spaced somewhat above the outlet 54 of the inverted cone. A threaded nut 55 has an inwardly extending flange 57 which overlies the inverted cone flange 52. The threads of the nut 55 engage with threads on the exterior of the separation body 50 such that the nut may be rotated to clamp an O-ring 59 between the inverted cone flange 52 and the upper rim of the separation body 50. The separation body 50 is disposed within a bowl 56 with a semispherical base 58. The bowl 56 is preferably similar to the bowl used on a Uniflow cleaner, with the upper 1.25 inches removed. The molded polypropylene bowl 56 may be hot air welded to the polypropylene separation body. After the bowl 56 has been connected to the separation body 50, three stainless steel pins 84, each about ⅛ inch in diameter and three-quarters of an inch long are inserted through three sets of aligned holes 86 equally spaced about the circumference of the separation body and the bowl. The pins 84 restrict rotation of the bowl with respect to the separation body 50.

A light rejects removal tube or vortex finder 60 is fixed to the bowl 56 to extend upwardly through the bowl and the separation body 50 into the inverted cone 44. The vortex finder 60 may be attached to the bowl with a threaded connection so the position of the upper termination of the tube may be adjusted. An outer metal ring 62 is press fit or shrink fit to the body 50, with an inner metal ring 64 press fit or shrink fit to the body concentric and within the outer metal ring and positioned substantially below the outer ring, as best shown in FIG. 3. The outer metal ring 62 may have an inner diameter of about 3.07 inches and a height of about two inches, with an outer diameter of approximately 3.25 inches. The inner metal ring 64 may have an internal diameter of 1.13 inches, a height of about 0.69 inches, and an external diameter of about 1.25 inches. The inverted cone 44 has a lower segment 88 which extends beneath the flange 52 and into the upper portion of the outer metal ring 62.

A generally annular heavy rejects chamber 66 is defined between the body 50 and the outer ring 62. A heavy rejects outlet tube 68 extends tangentially from the heavy rejects chamber 66, and pressure is drawn on the heavy rejects outlet tube to draw the heavy rejects fraction of the flow out of the cleaner 20. The lower wall 70 of the heavy rejects chamber 66 may be formed with a semicircular cross section to define a semi-toroidal volume, or, in a preferred embodiment, has a radiused corner where the lower wall 70 adjoins the outer wall 90 of the heavy rejects chamber 66. The outer wall 90 extends approximately perpendicular to the lower wall 70.

A generally annular region defined between the outer metal ring 62 and the vortex finder 60 serves as an "inverted hydrocyclone" chamber 72. As disclosed in my U.S. Pat. No. 5,566,835, the flow of heavy rejects within the inverted hydrocyclone chamber 72 may be pictured as a fluid roller bearing, which is matching the flow in the central region around the vortex finder both in downward velocity and in rotational speed. This matching of velocities avoids turbulence, and allows the heavy reject flow from the central region to be effectively split off, without mixing, from the accept flow. Furthermore, the fact that only a fraction of the heavy rejects is removed from the inverted hydrocyclone chamber through the heavy rejects chamber and heavy rejects outlet, allows a greater flow velocity of the heavy rejects component of the stock, as a significant fraction is recirculated.

However, although the inverted hydrocyclone disclosed in my prior patent demonstrated excellent results with a generally frustoconical chamber, which expanded as it extended downwardly, the cleaner 20 of this invention demonstrates good results with a generally cylindrical inverted hydrocyclone. The advantage of the simpler geometries of the cleaner 20 is less complex, and less expensive, tooling, and also reduced manufacturing costs.

Although the flow downward from the inverted cone 44 is spiraling about the vortex finder 60, the flow has a downward component, with the heavy rejects being radially outward from the accepts. Because of the flows introduced within the inverted hydrocyclone chamber 72, the downwardly flowing stock does not simply expand into the wider inverted hydrocyclone chamber 72. The rotation and axial flow rates of the stock within the inverted hydrocyclone chamber 72 is matched to the rotation and axial flow rates of the stock flowing past the inverted hydrocyclone chamber, reducing the occurrence of turbulence and maintaining the heavyweight contaminants in their location until the flow reaches the inner metal ring 64 which serves as a flow splitter. The inverted hydrocyclone chamber 72 has a lower wall 74 which has a semicircular cross section, thereby defining a semi-toroidal surface. The plastic material of the separation body 50 which defines the semi-toroidal lower wall 74 tapers until it meets the inner ring 64.

The inner ring 64 therefore defines an upwardly extending lip which extends into the downwardly flowing stock and which is positioned to split the flow of heavy rejects from the flow of accepts, and to turn the heavy rejects flow radially outwardly and cause it to flow upwardly along the inside of the outer ring 62. A portion of the reject flow is drawn out through the heavy rejects chamber 66. The flow rate out of the heavy rejects chamber through the heavy rejects outlet tube 68 is controlled by a valve on a heavy rejects take-away header, not shown. The outlet tube 68 in a preferred embodiment has a diameter of about ¾ inch.

The underside 76 of the separation body 50 is in the shape of an inverted truncated cone, with the vortex finder 60 passing through a cylindrical opening 78 at the center of the separation body. An accepts chamber 80 is defined between the bowl 56 and the underside 76 of the separation body. The bowl 56 has a floor 92 which is defined by a semicircle revolved about the axis of the vortex tube and hence it is semitoroidal. Fluid containing accepts fiber flows through the accepts chamber 80 and is drawn off tangentially through an accepts outlet 82. The back pressure on the accepts outlet 82 is regulated by a valve on an accepts manifold, not shown, which controls the back pressure for a number of cleaners 20. The desired back pressure may be varied for different types of furnishes and amount of dirt present in the input stock.

The annular region 78 defined between the inner ring 64 and the vortex finder 60 has an outer diameter which is less than the diameter of the outlet 54 of the inverted cone, for example about 1.15 inches. The accepts flow through the annular region 78 will be less than the combined flow of accepts and heavyweight rejects into the separation body by the amount of heavyweight reject flow out through the heavy rejects outlet 68. In other words, the cross-sectional area of the annular region 78 is selected to retain the axial flow velocity of the acceptable particle fluid passing through the annular region approximately equal to the flow velocity of the combined heavyweight particle and acceptable particle flow in to the separation body 50. Thus the volume flow of acceptable particle flow through the annular region 78 into the accepts chamber 80 is equal to the volume flow of combined acceptable particle and heavyweight reject flow into the separation body less the volume flow of heavyweight reject flow out the heavy rejects outlet 68.

As shown in FIG. 3, the infed stock flows from the stock inlet, through the internal chamber 40 past the channel dam 42 and through the inverted cone 44. In the course of the stock's progress along this route, the light rejects 32 tend to remain along the axis of flow, and they are removed through the vortex finder 60. Air present in the stock comes out of the stock and defines an air core co-axial with the vortex finder 60. The air core diameter is slightly less than the diameter of the vortex finder. The accepts and heavy rejects 30 are displaced to the walls of the inverted cone 44 and pass into the separation body 50, where, through the operation of the fluid flows within the inverted hydrocyclone chamber 72, the heavy rejects 30 are removed through the heavy rejects outlet tube 68, and the accepts 28 pass by the inner metal ring around the vortex finder and into the accepts chamber 80 for removal through the accepts outlet 82. As the accepts fluid is drawn off tangentially from the accepts chamber 80, the accepts fluid rotates within the accepts chamber. This continuous rotation of the accepts fluid mass contributes to evening out the flow through the cleaner 20 in a manner which may be visualized by thinking of the effect a flywheel has on a rotating shaft.

It has been determined that optimal performance of the cleaner 20 is obtained when the distance between the outlet 54 of the inverted cone 44 and the top of the inner ring 64 is 1.56 inches, with good performance obtainable with plus or minus 0.125 inches from this measurement.

It will be noted that the geometry of the separation body 50, as shown in FIG. 3, is such that it may be formed as a molded plastic part without significant undercuts, and generally employing simple cylindrical, semi-toroidal, or frustoconical surfaces. In addition, because the cleaner 20 shares many of the parts of a conventional Uniflow cleaner, it may be manufactured with a minimum of additional parts. Furthermore, the cleaner is readily retrofitted into existing cleaner bank installations, as both the head and the bowl of the cleaner have similar dimensions to prior art units.

It should be noted that the cleaner 20, as shown in FIGS. 1 and 2, is shown shorter in the vertical dimension than a preferred embodiment. Typically, the height of the cleaner 20 will be about 36 inches with a diameter at the channel dam segment of about four inches. The cleaner may be supplied with inflowing stock at the inlet at a pressure of 48 psi and a rate of 55 gallons per minute. The pressure at the heavy rejects outlet 68 may be 28 psi, the pressure at the accepts outlet 82 may be 14.9 psi, with the light rejects removal tube 60 discharging to atmospheric pressure (all pressures are gauge pressures). However, cleaners of varying diameters and heights may also be made according to this invention.

The metal parts in the cleaner are preferably formed of corrosion-resistant components, for example stainless steel.

It is understood that the invention is not limited to the particular construction and arrangement of parts herein illustrated and described, but embraces such modified forms thereof as come within the scope of the following claims.

I claim:

1. A cleaner for separating heavy reject particles and light reject particles from acceptable particles in an input fluid flow, the cleaner comprising:

a head having portions defining an inlet therein for the admission of input fluid flow;

a channel dam segment positioned beneath and connected to the head, the channel dam segment having inwardly extending annular portions, the entire input fluid flowing through the annular portions;

an inverted cone connected beneath the channel dam and extending downwardly to an outlet;

a tube which extends upwardly along the axis of the inverted cone to receive light reject particles and to carry them away from the cleaner;

a separation body positioned beneath the inverted cone to receive the fluid which is discharged therefrom, wherein the separation body has an outer cylindrical ring positioned coaxial with the tube, and an inner cylindrical ring, the inner cylindrical ring defining an upwardly extending lip which extends into the downwardly flowing fluid and which is positioned to split a fluid flow of heavy rejects from a fluid flow of accepts, the inner cylindrical ring positioned radially inwardly of and coaxial with the outer ring;

wherein the outlet of the inverted cone and the top of the inner ring are spaced apart between 1.435 and 1.685 inches;

a bowl fixed to the separation body to define an accepts chamber between the bowl and the separation body;

an accepts outlet connected to the accepts chamber, wherein acceptable particles are drawn out of the accepts chamber though the accepts outlet; and a heavy rejects outlet extending from the separation body, wherein a heavy rejects chamber is defined between the separation body and the outer ring, and wherein acceptable particles flow through the inner ring to the accepts chamber.

2. The cleaner of claim 1 wherein the inwardly extending annular portions of the channel dam segment comprise a metal annular ring which is engaged between portions of the inverted cone and the channel dam segment.

3. The cleaner of claim 1 wherein the outer cylindrical ring and the inner cylindrical ring are metal rings which are engaged with the separation body, and wherein the separation body is formed of plastic.

4. The cleaner of claim 1 wherein the separation body has an underside which faces the bowl, and wherein the underside has portions defining a truncated cone which narrows as it extends toward the bowl.

5. The cleaner of claim 1 wherein portions of the separation body define a heavy rejects outer wall which is approximately perpendicular to a heavy rejects lower wall, the heavy rejects chamber being defined between the heavy rejects outer wall, the outer ring, and the heavy rejects lower wall.

6. The cleaner of claim 1 wherein the inverted hydrocyclone chamber has a bottom wall which has a semi-circular cross section to define a substantially semi-toroidal surface.

7. An assembly for separating light rejects and heavy rejects from the acceptable particles in a fluid flow discharged from an inverted cone, the assembly comprising:

a separation body having an inner cylindrical hole, and an upwardly opening first semi-toroidal lower wall is defined encircling the cylindrical hole, and a second lower wall is defined by portions of the separation body exterior to the first semi-toroidal lower wall;

an outer ring which is connected to the separation body between the first lower wall and the second lower wall;

an inner ring which is connected to the separation body between the inner cylindrical hole and the first lower wall again, the inner ring forming a splitter between heavy rejects and acceptable particles in the fluid flow;

a bowl connected beneath the separation body to define an acceptable particle chamber therebetween;

a light reject particle tube extending upwardly through the separation body inner hole such that acceptable particles can pass through an annular region defined between the tube and the inner hole into the accepts chamber; and a heavy rejects outlet connected to the separation body to draw fluid from a heavy rejects compartment defined radially outwardly of the outer ring.

8. The assembly of claim 7 wherein the inner ring and the outer ring are composed of metal, and the separation body is composed of plastic.

9. The cleaner of claim 7 wherein the separation body has an underside which faces the bowl, and wherein the underside has portions defining a truncated cone which narrows as it extends toward the bowl.

10. A through flow cleaner for the extraction of light reject particles and heavy reject particles from a flow of acceptable particles, the cleaner comprising:

a head having portions defining an inlet for the introduction of an input stock into the cleaner;

a generally conical chamber extending downwardly from the head, the conical chamber of decreasing diameter as it extends away from the head;

a separation body positioned beneath the conical chamber;

a light rejects tube which extends through the separation body and extends along the axis of the conical chamber;

a first generally cylindrical passageway defined between the tube and the separation body, wherein acceptable particles flow through the first passageway through the separation body;

a bowl positioned beneath and connected to the separation body to receive the acceptable particle flows in a chamber defined between the separation body and the bowl;

an inverted hydrocyclone chamber defined radially outwardly of the first passageway, the inverted hydrocyclone chamber having a generally cylindrical outer wall; and a heavy rejects chamber defined exterior to the inverted hydrocyclone chamber, the outer wall thereof being generally cylindrical and substantially coaxial with the tube, wherein an outer cylindrical ring is positioned between the inverted hydrocyclone chamber and the heavy rejects chamber, the outer ring defining the outer wall of the inverted hydrocyclone chamber.

11. The cleaner of claim 10 further comprising a metal annular ring which is positioned between the conical chamber and the head.

12. The cleaner of claim 10 wherein the separation body has an underside which faces the bowl, and wherein the underside has portions defining a truncated cone which narrows as it extends toward the bowl.

13. The cleaner of claim 10 wherein the outer ring defining the outer wall of the inverted hydrocyclone chamber is a metal ring and wherein the conical chamber extends downwardly within the metal ring.

14. The cleaner of claim 10 wherein the inverted hydrocyclone chamber has a bottom wall which has a semi-circular cross section to define a substantially semi-toroidal surface.

15. A through flow cleaner for the extraction of light reject particles and heavy reject particles from a flow of acceptable particles, the cleaner comprising:

a head having portions defining an inlet for the introduction of an input stock into the cleaner;

a generally conical chamber extending downwardly from the head, the conical chamber of decreasing diameter as it extends away from the head;

a separation body positioned beneath the conical chamber;

a light rejects tube which extends along the axis of the conical chamber and which carries light rejects out of the cleaner;

an outer cylindrical ring positioned within the separation body;

an inner ring connected to the separation body coaxial with the light rejects tube and positioned inwardly of the outer ring, wherein a heavy rejects chamber is defined between a generally cylindrical wall of the separation body and the outer cylindrical ring and a heavy rejects outlet extends tangentially from the heavy rejects chamber for the extraction therethrough of heavy reject particles;

an inverted hydrocyclone chamber defined radially inwardly of the outer cylindrical ring and radially outwardly of the inner ring;

a bowl positioned beneath and connected to the separation body to receive acceptable particle flows passing through the inverted hydrocyclone chamber in a chamber defined between the separation body and the bowl.

16. The cleaner of claim 15 wherein the separation body has an underside which faces the bowl, and wherein the underside has portions defining a truncated cone which narrows as it extends toward the bowl.

17. A through flow cleaner for separating light rejects and heavy rejects from the acceptable particles in a fluid flow, comprising:

an inlet head for the introduction of the fluid flow into the cleaner;

an inverted cone connected to the inlet head, the cone of decreasing diameter as it extends downwardly;

a separation body having an inner hole, and an upwardly opening first lower wall is defined encircling the cylindrical hole, and a second lower wall is defined by portions of the separation body exterior to the first lower wall;

an outer cylindrical ring which is connected to the separation body between the first lower wall and the second lower wall, wherein portions of the inverted cone extend downwardly within the outer ring;

a bowl connected beneath the separation body to define an acceptable particle chamber therebetween;

a light reject particle tube extending upwardly through the separation body inner hole such that acceptable particles can pass through an annular region defined between the tube and the inner hole into the accepts chamber; and a heavy rejects outlet connected to the separation body to draw fluid from a heavy rejects compartment defined radially outwardly of the outer ring.

* * * * *